US005125195A

United States Patent [19]

Brede

[11] Patent Number: 5,125,195

[45] Date of Patent: Jun. 30, 1992

[54] SPACER FOR AN INSULATING GLASS UNIT

[75] Inventor: Peter Brede, Huckeswagen, Fed. Rep. of Germany

[73] Assignee: Helmot Lingemann GmbH & Co., Fed. Rep. of Germany

[21] Appl. No.: 690,772

[22] Filed: Apr. 24, 1991

[30] Foreign Application Priority Data

Mar. 20, 1991 [DE] Fed. Rep. of Germany ..... 9103448

[51] Int. Cl.[5] ..... E06B 7/12

[52] U.S. Cl. ..... 52/171; 52/788

[58] Field of Search ..... 52/171, 172, 790, 788; 49/DIG. 1

[56] References Cited

U.S. PATENT DOCUMENTS

| | | | |
|---|---|---|---|
| 2,974,377 | 3/1961 | Kunkle | 52/790 |
| 3,791,910 | 2/1974 | Bowser | 52/172 |
| 3,919,023 | 11/1975 | Bowser | 52/172 |
| 4,335,166 | 6/1982 | Lizardo | 52/172 |
| 4,807,419 | 2/1989 | Hodek | 52/172 |

FOREIGN PATENT DOCUMENTS

| | | | |
|---|---|---|---|
| 2445332 | 4/1976 | Fed. Rep. of Germany | 52/790 |
| 2518205 | 4/1976 | Fed. Rep. of Germany | 52/790 |
| 2526438 | 12/1976 | Fed. Rep. of Germany | 52/790 |

*Primary Examiner*—David A. Scherbel
*Assistant Examiner*—Creighton Smith
*Attorney, Agent, or Firm*—Jones, Askew & Lunsford

[57] ABSTRACT

A spacer to bridge the interspace between two parallel panes of glass in a multilayer insulating glass. The spacer includes two hollow metal sections mutually spaced apart. A solid web of an unfoamed and fully-cured polyurethane casting compound fills the space between the hollow sections and adheres to the facing surfaces of the sections. The hollow sections and solid web form a spacer having relatively high torsional rigidity and electrical insulation, and having relatively low thermal conductivity between the glass panes. The outside surface of the web is covered with a layer impermeable to vapor.

7 Claims, 1 Drawing Sheet

SPACER FOR AN INSULATING GLASS UNIT

This invention concerns the field of heatable insulating glass units of at least two panes of glass held together at a distance by a spacer with the interspace filled with gas or evacuated.

With such an insulating glass unit, extremely thin electric strip conductors with the corresponding connections for conducting an electric current are provided on the surface of one of the two panes of glass facing the interspace. The pane of glass is heated by applying an electric current to the strip conductors, absorbs heat and should release the heat to the air of the room of a building by convection and/or radiation. In designing the insulating glass unit, the spacer must assure special properties. It must not just store the desiccant as usual and assure access of the internal atmosphere within the interspace to the desiccant but must also have enough strength, especially torsional rigidity for the insulating glass unit to be easily handled and it must also provide adequate electric insulation and thermal insulation.

Spacers of aluminum, steel and plastic are known. The best electric and thermal insulation is provided by plastic, but plastic does not have enough strength or torsional rigidity and it becomes brittle especially under the influence of alternating temperatures and UV radiation and it softens on exposure to high temperatures. Steel has adequate strength, but it has a relatively high electric conductivity and high thermal conductivity. However, aluminum is the least suitable, although aluminum spacers have proven to be excellent for normal (i.e., not heatable) insulating glass units with regard to shaping and strength. The thermal conductivity and electric conductivity of aluminum are disproportionately higher than those of other materials (thermal conduction of aluminum/steel/plastic = 200:52:0.22).

There are known heatable insulating glass units with plastic spacers. The disadvantages described here are just accepted but it is expected that these heatable insulating glass units will not retain the required long-term properties.

Furthermore, a heatable insulating glass unit with a spacer made of metal is also known, and a thick cushioning element of a rubber elastic substance that should provide primarily sound insulation and secondarily electric and thermal insulation is provided between the side surfaces of the spacer and the panes of glass. However, it has been found that although the sound insulation is good, the thermal insulation is inadequate and the electric insulation is not optimum.

A development that provides a glass web of an insulating layer between the usual water vapor-impermeable butyl layer on the side of the spacer frame and the pane of glass equipped with the heating elements attempts to overcome the problems that occur when using metal spacers because of the electric conductivity (European Patent A 250,386). However, the strength of this sandwich structure cannot be guaranteed. Furthermore, production of such a sandwich structure is very expensive.

However, German Utility Patent 88 12 216.6 by the present applicant is based on the idea of preserving the usual structure of insulating glass units and using two or more parallel hollow metal spacer sections arranged with a distance between them, preferably hollow aluminum sections with side walls parallel to the surfaces of the panes of glass as the only spacers in which case the interspace between the two hollow sections is filled with a plastic that adheres firmly to the surface of the side walls of the hollow sections of a polyurethane casting compound. The plastic in the interspace forms an insulating web produced from a mixture of a completely formulated phase-unstable lowviscosity polyol formulation that contains a water-binding additive (Baydur VP PU 1397) with a liquid, solvent-free diphenylmethane 4,4'-diisocyanate containing isomers and higher functional homologs (Desmodur 44 V10 B or Desmodur 44 V20 B) (Baydur: manufactured by Bayer AG; Desmodur: manufactured by Bayer AG). The insulating web is produced, for example, from 90 to 110 parts by weight, especially 100 parts by weight Baydur VP PU 1397 and 90 to 100 parts by weight, especially 97 parts by weight Desmodur 44 V10 B or Desmodur 44 V20 B. The hollow sections of the spacer are filled with a desiccant. A vaporimpermeable bonding cement, especially of butyl, is provided between the outside walls of the spacer and the surfaces of the panes of glass facing the interspace. The space beneath the spacer is filled with a more or less plastic elastic bonding cement, especially Thiokol.

It was surprising that it is sufficient to use two spacer tubes that are arranged so they are insulated electrically from each other and also have a high strength, especially a high torsional rigidity. The usual remaining structure of a normal insulating glass unit (e.g., German Patent A 2,518,205, FIG. 3) can remain unchanged.

The success described here with the older proposal by the present applicant is based essentially on the choice of substances for the insulation material between the spacer tubes. However, it has been found that the selected insulation material is not sufficiently impermeable to gas in many cases, and especially does not have a sufficient water vapor impermeability, so moisture can penetrate into the interspace in the insulating glass and thus have a negative effect on the thermal insulation of the insulating glass as well as the electric insulation of the insulating material. Therefore, there has been no lack of attempts to overcome these shortcomings by means of additives to the insulation material, for example, but success has not yet been achieved.

The purpose of this invention is to improve the spacers known from German Utility Patent 88 12 216.6 for a heatable insulating glass unit in such a way that, when installed, it will retain its airtightness for a long period of time, but especially the water vapor impermeability will be assured and its excellent electric insulating properties will be retained.

This invention will be illustrated in greater detail below with reference to the figures which show the following:

Figure 1:
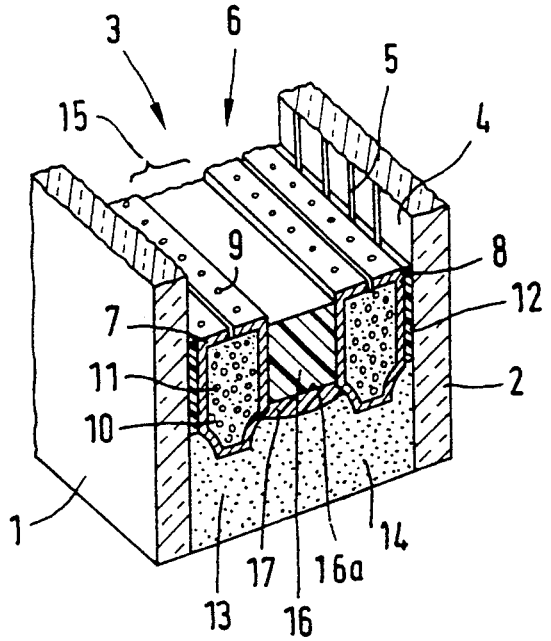
FIG. 1 shows perspective and schematic cutaway views of the structure of a heatable insulating glass unit with the spacer according to this invention.

The heatable insulating glass unit is inserted into a window frame or a door frame (not shown). It consists essentially of the two parallel panes of glass 1 and 2 that are arranged with a distance between them, forming interspace 3. Strip conductors 5 of a resistance heating element (not shown) are applied by sputtering or vapor deposition, for example, to the surface 4 of one pane of glass 2 facing the interspace. The electric terminals and the entire structure of the resistance heating element need not be described in detail because they are part of the state of the art and are not critical for the purposes of this invention.

Figure 2:
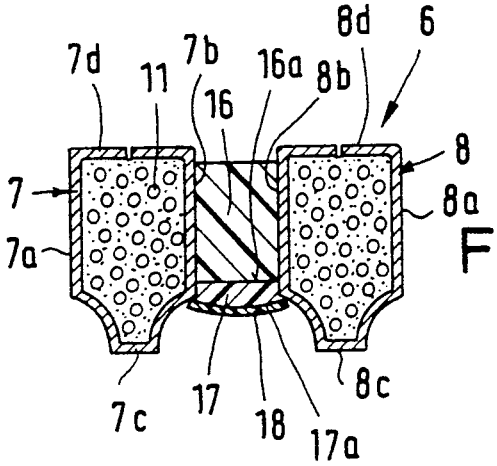
FIG. 2 shows a front view of a spacer according to this invention.
Figure 3:
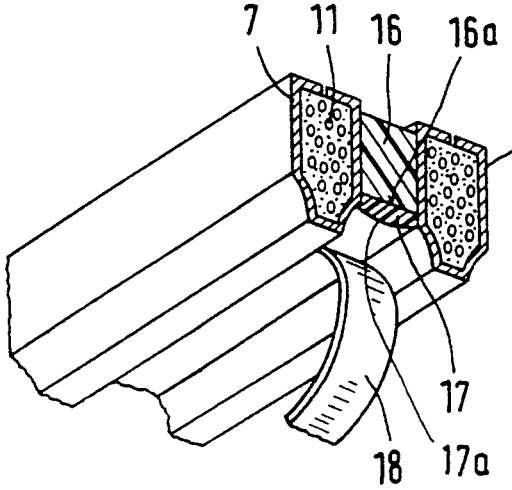
FIG. 3 shows a part of the spacer according to this invention in perspective view.

Interspace 3 is bridged by a spacer 6 which is shown in a frontal view in FIG. 2 and whose structure is essential to this invention.

Spacer 6 preferably consists of two parallel hollow aluminum sections 7 and 8 arranged with a distance between them and with side walls *7a*, *7b* and *8a*, *8b*, a bottom wall *7c*, *8c* and a top wall *7d*, *8d* parallel to the surfaces of the panes of glass. Holes 9 are provided in the cover wall by a known method to create a connection between the interior 10 of hollow sections 7, 8 which are filled with desiccant 11 and interspace 3. Between walls *7a* and *8a* and the surfaces of panes of glass 1 and 2 facing the interspace, it is expedient to provide a butyl layer 12 as the connecting element and as a water vapor barrier, as is already known. However, other bonding substances that fulfill the same purpose may also be provided there.

Space 13 beneath spacer 6 is preferably filled with a bonding cement 14 such as Thiokol. The bonding cement serves as a plastic elastic bonding and adhesive composition. It is essential for the interspace 15 between the two hollow sections 7 and 8 to be filled with a product that forms a hard substance that bonds tightly or adheres well to aluminum and creates a uniform solid spacer with torsional rigidity and while also providing excellent electric insulation and also having an extremely low thermal conductivity. Furthermore, the product or the substance must be resistant to UV light and heat. A substance has been found for this purpose through an inventive selection.

A solid web of insulation 16 consisting of an unfoamed, cured polyurethane casting compound is provided between hollow sections 7 and 8. The raw material for this insulation web 16 is marketed by Bayer AG under the brand name Baydur VP PU 1397. It is a completely formulated phase-unstable low-viscosity polyol formulation that contains a water-binding additive. Before processing, the blend must be homogenized well. During processing, it should be stirred slowly and continuously. The formulation has the following properties:

| | | |
|---|---|---|
| Hydroxyl value | (mg KOH/g) | 355 ± 20 |
| Water content | (%) | <0.20 |
| Viscosity at 25° C. | (mPa · s) | 1200 ± 200 |
| pH | | about 11.5 |
| Density at 25° C. | (g/cm$^3$) | about 1.05 |
| Flash point | (°C.) | 120° C. |
| Solidification range | (°C.) | −28 to −26° C. |

The lower limit of the processing temperature is 23° C. The activity of Baydur VP PU 1397 may be changed at temperatures above 35° C. The processing temperature of the raw materials should be at least 23° C. For a characteristic value of 108, the following processing formulations can be given:

100 parts by weight Baydur VP PU 1397
97 parts by weight Desmodur 44 V 10 B
or 97 parts by weight Desmodur 44 V 20 B The following processing characteristic data were determined at a raw materials temperature of 28° C. and are characteristic of the system:

| | | |
|---|---|---|
| Gelation time | (sec) | 30 ± 10 |
| Mold temperature | (°C.) | 30 − 75 |
| Gross density, cast in the mold | (kg/m$^3$) | 1180 |

For example, at a processing temperature of 23° C. for the raw materials, 100 kg Baydur VP PU 1397 are weighed with 970 kg Desmodur 44 V10 B and stirred with a stirrer for 10 seconds at about 2000 rpm to produce the proper blend. The setup time between the start of stirring and setup of the reaction mixture is 60+10 seconds. At the time of set up, the casting compound solidifies suddenly.

Baydur VP PU 1397 is a preparation based on polyols.

Insulating web 16 has the following properties, for example:

| | | | Baydur VP PU 1397/ Desmodur 44 V10 B |
|---|---|---|---|
| Test specimen density | | mm [sic] | 1010 |
| Gross density | DIN 53,432 | kg/m$^3$ | 1170 |
| Flexural strength | DIN 53,432 | MPa | 72 |
| Sagging at break | DIN 53,432 | mm | 20 |
| Modulus of elasticity in flexure | | MPa | 1500 |
| Tensile strength | DIN 53,432 | MPa | 47 |
| Tensile elongation | DIN 53,432 | % | 21 |
| Impact strength | DIN 53,432 | kJ/m$^2$ | 60 |
| Hardness according to Shore D | DIN 53,505 | | 74 |
| Behavior in the heat under bending stress | DIN 53,432 | °C. | 110 |

The processing shrinkage amounts to only 0.8±0.1% of the production tolerance. This value is valid for production of an insulating web 16 up to 100 mm thick with a gross density of 1180 kg/m$^3$ if the processing formulation with Desmodur 44 V10 B as indicated above is maintained and with a dwell time of 1 minute in a mold heated to 75° C.

Desmodur 44 V10 B is a liquid solvent-free diphenylmethane 4,4'-diisocyanate that contains a certain amount of isomers and higher functional homologs. It is used in combination with polyols to produce Baydur. As a rule, it has the following delivery specifications:

| | |
|---|---|
| Isocyanate content | 31.5 wt % ± 1 wt % |
| Viscosity at 25° C. | 130 mPa · s ± 20 mPa · s |
| Acidity | max. 0.06 wt % |
| Total chlorine | max. 0.5 wt % |
| Phenyl isocyanate content | max. 50 ppm |

The technical properties are as follows:

| | |
|---|---|
| Color | brown |
| Density at 20° C. | 1.23 to 1.24 g/cm$^3$ |
| Flash point | more than 200° C. |
| Vapor pressure (MDI) at room temperature | <10$^{-5}$ mbar |

Due to the selection of this substance, it has been possible to create a spacer with optimum electrical insulation. The width of the solid insulating web 16 is preferably ⅓ to 1/6 of the total width of spacer 6.

If it is recalled that spacers made of plastic in combination with sealing compounds do not meet the long-term requirements of testing institutes and manufacturers of insulating glass units, then it can be considered surprising that the substance selected here fulfills all the required properties for insulating web 16. For example, when two 5.5 mm wide welded spacer sections 7 and 8 (which are excellent for this purpose due to their great inherent stability) are combined with the selected plastic, which should provide the required thermal and electric separation, optimum separation properties are achieved even in the corner areas. In addition, however, it is also surprising that the new spacer section can be bent to a corner in the corner area without the plastic preventing such bending.

The selected plastic fulfills the following requirements:

thermal stability >70° C. and >minus 35° C.

good bonding properties to aluminum good bonding properties to the sealing compounds needed for aluminum production resistance to gas diffusion separation of electric conductivity minimized thermal diffusion.

Another favorable property of the selected polyurethane plastic is that it can be combined permanently with the coatings that have already been developed for aluminum spacers so that colored spacers can be created. In particular the use of UV-resistant coatings is possible.

Another especially important possibility consists of pigmenting the polyurethane plastic and in this way creating a decorative spacer.

Attempts to convert an extruded plastic profile in combination with adhesives to a stable, torsionally resistant system have so far failed owing to the low inherent stability as well as the risk of diffusion of the adhesive and also because of the complications in handling. Furthermore, there are the enormous production costs resulting from the expensive production method.

Use of two spacer sections in combination with a liquid two-component polyurethane plastic leads to the production of an optimum spacer. Continuous synchronous application of the polyurethane between two parallel spacer sections in production and subsequent curing lead to a compact bonding of the spacer sections. These meet the requirements stipulated above. Thus a problem solution has been discovered that was not readily apparent.

With the known heatable insulating glass units, thermal insulation values between 1.1 and 2.6 $W/m^2K$ have been reported and values between 2.83 and 2.88 $W/m^2K$ have been measured, as reported in test reports on such insulating glass units, but it must be considered surprising that the insulating glass unit described here assures thermal conduction coefficients or thermal insulation values of about 0.45 $W/m^2K$, especially between 0.3 and 0.7 $W/m^2K$. It is not yet known to what this extremely great difference in values can be attributed.

The electric insulation of insulating web 16 is also complete.

However, it has been found that insulating web 16 of this special material is water vapor-permeable when the water vapor partial pressure exceeds a certain level. The water vapor can penetrate from the outside through space 13 or through bonding cement 14 in space 13 at the insulating web 16. If water vapor penetrates into insulating web 16, the electric insulation is diminished or electric conductivity can occur. If the water vapor penetrates through insulating web 16, it will reach interspace 3 between the panes of glass and will thus be adsorbed by desiccant 11 in hollow spacer sections 7 and 8 until the desiccant has been spent. Since interspace 15 between hollow spacer sections 7 and 8 is large, substantial quantities of water can pass through insulating web 16 into the interspace 3 so over a long period of time the desiccant cannot process such quantities that can accumulate in different amounts over a period of time. The result is condensation on the inside of the panes of glass and loss of thermal insulation.

This invention solves this problem in an amazingly simple manner by providing a spacer 6 whereby the outside surface 6*a* facing space 13 is covered with a vapor-impermeable layer 17 that consists, for example, of butyl, a material that is also used on the side of spacers 6 as a water vapor-impermeable and tacky layer 12.

In order for spacer 6 to be easily handled—spacers are supplied to the manufacturers of insulating glass in the form of bars cut to length—the free surface 17*a* of the tacky butyl layer 17 is covered with a strip of paper and/or plastic 18 so the tackiness of the butyl does not cause interference in handling and the free surface of butyl layer 17 is not soiled. Strip 18 is removed just before installing spacer 6 between panes of glass 1 and 2 and then butyl layer 17 contracts with the bonding cement 24.

Thus it is possible with very simple means to make available a spacer 16 for heatable insulating glass units that will be water vapor diffusion-proof and easily handled.

I claim:

1. A spacer for heatable multilayer insulating glass comprising at least two panes of glass held a distance apart by means of a spacer with a gas-filled or evacuated interspace (3) between the panes and a resistance heating element on a glass surface facing the interspace and with connections for supplying an electric current to the resistance heating element, the spacer comprising:

two parallel hollow metal sections (7,8) arranged with a distance between them and having side walls (7*a*, 7*b* and 8*a*, 8*b*) parallel to the glass surfaces, the mutually-facing surfaces (7*b*, 8*b*) of the sections defining an interspace (15) between the hollow sections;

a solid web (16) of an unfoamed and fully-cured polyurethane casting compound filling the interspace (15) between the hollow sections (7,8) and adhering well to the mutually-facing surfaces (7*b*, 8*b*) of the hollow sections (7,8);

the web being hard and forming a permanent bond with the hollow sections so that the hollow sections and hard web bonded thereto create a uniformly strong spacer having relatively high torsional rigidity and electrical insulation, and having relatively low thermal conductivity between the panes; and the web (16) having an outside surface (16*a*) covered with a vapor-impermeable layer (17), so as to prevent moisture from penetrating the web and entering the interspace between the hollow sections.

2. Spacer according to claim 1, characterized in that layer (17) consists of butyl.

3. Space according to claim 1, characterized in that the free outside surface (17*a*) of layer (17) is covered with a strip (18).

4. Spacer according to claim 3, characterized in that strip (18) is made of paper.

5. Spacer according to claim 3, characterized in that strip (18) is made of plastic.

6. Spacer according to claim 3 characterized in that there is an adhesive bond between layer (17) and strip (18).

7. Spacer according to claim 6, characterized in that strip (18) can be pulled away before using spacer (6) without having any negative effect on layer (17).

* * * * *